United States Patent [19]

Chavee

[11] 4,023,499

[45] May 17, 1977

[54] FUSE FOR RIFLE-GRENADE

[75] Inventor: Rene M. Chavee, Genk, Belgium

[73] Assignee: Fabrique Nationale Herstal S.A., Herstal-lez-Liege, Belgium

[22] Filed: May 1, 1975

[21] Appl. No.: 573,565

[30] Foreign Application Priority Data

Jan. 7, 1975 Belgium ..... 254070

[52] U.S. Cl. ..... 102/76 R; 102/65.2; 102/78

[51] Int. Cl.² ..... F42C 15/00

[58] Field of Search ..... 102/65.2, 76 R, 77, 102/78, 80

[56] References Cited

UNITED STATES PATENTS

| | | | |
|---|---|---|---|
| 2,371,151 | 3/1945 | Church et al. | 102/78 |
| 3,157,125 | 11/1964 | Lohmann | 102/78 |
| 3,388,666 | 6/1968 | Walter | 102/65.2 |
| 3,410,214 | 11/1968 | Irion | 102/78 |
| 3,439,615 | 4/1969 | Forman et al. | 102/78 X |

FOREIGN PATENTS OR APPLICATIONS

| | | | |
|---|---|---|---|
| 1,198,830 | 12/1959 | France | 102/65.2 |
| 10,219 | 4/1913 | United Kingdom | 102/65.2 |
| 8,708 | 6/1915 | United Kingdom | 102/65.2 |

*Primary Examiner*—Harold Tudor
*Attorney, Agent, or Firm*—Bacon & Thomas

[57] ABSTRACT

A fuse of the type disclosed in U.S. patent application 476,194 has a rod passing through a supporting disc and is axially shifted for releasing a rotor mechanism, it is provided with a head having a diameter larger than that of the said rod and which is in blocking relation to the rotor, said disc being blocked by a stationary disc forming a stop in fixed position and being locally deformed by the axial shifting of the said rod when the fuse is armed.

3 Claims, 6 Drawing Figures

FUSE FOR RIFLE-GRENADE

This invention relates to improvement in a fuse as described in U.S. patent application Ser. No. 476,194, filed June 4, 1974, to the same Applicant, now U.S. Pat. No. 3,960,084.

Said patent application describes a fuse for a rifle-grenade of the type comprising a body having an axial bore closed on one side by a detonator-carrying member and terminated at the other end by a housing for a propelling charge, a jacket extending within the said bore and containing an inertia striker, a locking means for the said striker, said means being controlled by a bolt a portion of which surrounds the said jacket and one end of which extends, at rest, up to the said housing for the propelling charge, and shearable pins maintaining the said bolt in a position for controlling the said locking means until combustion of the charge. The said detonator carrying member is in the form of a supporting disc the front face of which bears a rotor containing an off center relay charge, it being possible to bring the latter into alignment with the pyrotechnic chain by rotating the said rotor under the action of a spring, said rotation being controlled by an anchor mechanism normally locked by a rod passing through the said supporting disc and being moved by the said bolt for releasing the said mechanism as a result of the combustion of the propelling charge.

In the embodiment described and illustrated in the prior patent referred to, the rod for releasing the anchor mechanism comprises a locking head, secured by a deformable means, between two fingers integral with the said anchor. On the other hand, the said deformable means consists of a cup secured to the said supporting disc, a portion of the peripheral edge of said cup engaging a groove provided therefor in the head of the said rod.

While the prior construction gave good results, it has, however, been modified with a view to preserving the safety conditions when a part of the anchor mechanism fails and also so that the whole mechanism is not stressed when stored.

For this double purpose and according to the present improvements, the said cup integral with the disc does not engage a groove provided therefor in the head of the rod, but it is conditioned to overlie a portion of the said head. On the other hand, the fuse is locked directly upon the rotor and not upon the anchor. For this purpose, the said rod comprises a locking head secured by a deformable means within a notch provided in the rotor. These improvements may be carried out under varying forms. By way of a non limitative example, an embodiment will be described hereafter with more details, reference being made to the enclosed drawings in which:

Figure 5:
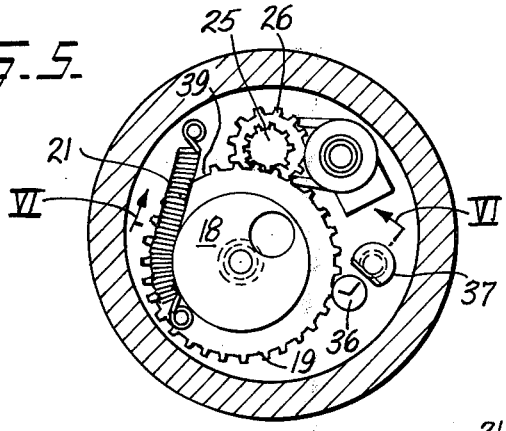
FIG. 5 is an end view taken in the direction of the arrow F5 of FIG. 4.
Figure 6:
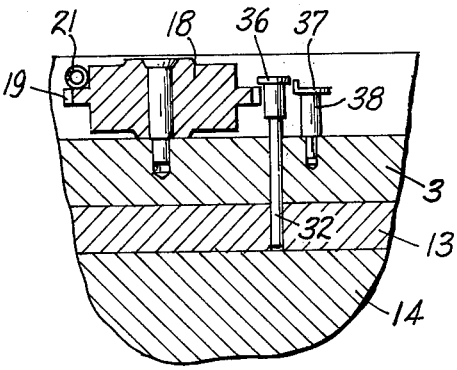
FIG. 6 is a section taken on the line VI—VI of FIG. 5.

This embodiment comprises all the elements disclosed in the U.S. Pat. No. 3,960,084 but completed by the improvements forming the object of the present invention. More particularly as regards the release of the mechanism, a rod 32 (FIGS. 5 & 6) is slidable in the disc 3 which rotatably supports rotato 18 and is provided at one end with a head 36 the diameter of which is larger than that of the said rod 32. The other end of rod 32 extends into the path of movement of a portion of bolt 14. The head 36 is blocked by a disc 37 integral with a stationary rod 38 fixed to disc 3. This arrangement is such that, at the impact of the other end of the said rod 32 by bolt 14 when charge 5 is fired, the disc 36 bends the stationary disc 37 and moves therepast to release the rotor 18, as shown in FIG. 6.

Figure 1:
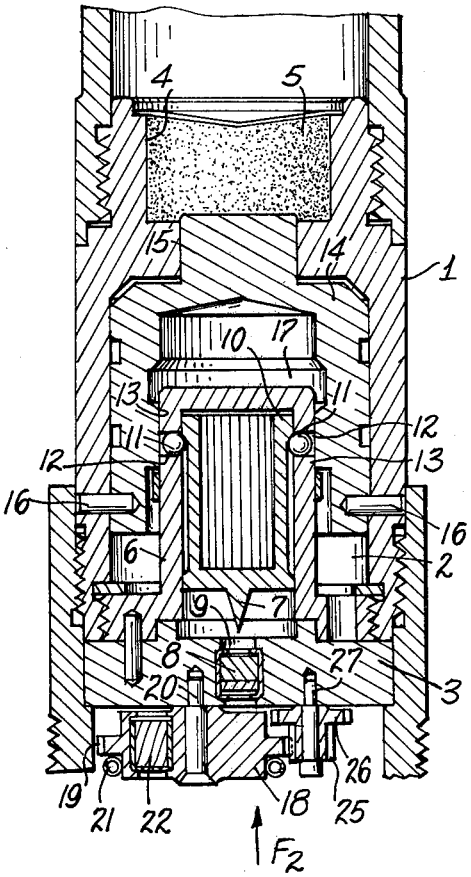
FIG. 1 is a section of a fuse according to the invention the fuse being in unarmed position.
Figure 4:
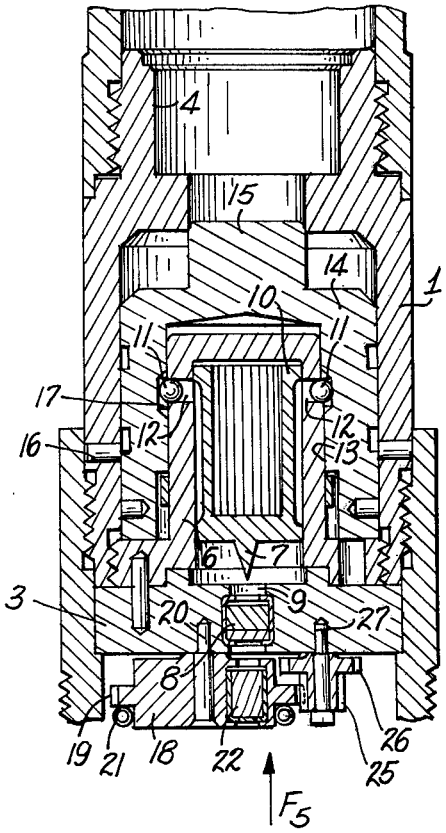
FIG. 4 is a section similar to that of FIG. 1, the fuse being in armed position.
Figure 2:
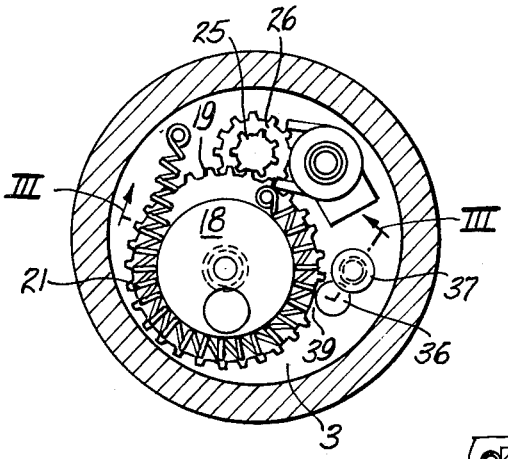
FIG. 2 is an end view taken in the direction of the arrow F2 of FIG. 1.
Figure 3:
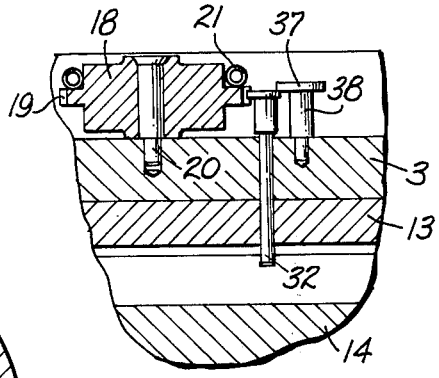
FIG. 3 is a section taken on the line III—III of FIG. 2.

The rotor 18 is locked against rotation in accordance with the improved arrangement, by direct engagement of head 36 with the rotor. For this purpose, the toothed crown 19 surrounding the rotor 18 has a spacing 39 formed e.g. by removing one or several teeth. In the locked position such as represented in FIG. 2, the head 36 of the rod 32 engages the said spacing 39. The axial shifting of the said rod 32 by bolt 14 induces deformation of the disc 37 by the head 36 of the rod 32 and the removal of the head 36 of the rod 32 from the said spacing 39, thereby releasing the rotor mechanism which is then rotated by spring 21 to complete the pyrotechnic chain. The invention covers the said improvements, the mechanisms using them as well as the fuses applying such improved mechanism.

What I claim is:

1. In a fuse device having a movable bolt movable to an arming position to release an inertia striker, said inertia striker being arranged to strike a detonator upon impact of said device with a target, a rotor carrying a pyrotechnic charge responsive to said detonator but in a first rotary position wherein said charge is remote from said detonator and being spring biased toward a second position wherein said charge is adjacent said detonator, the improvement comprising:

a rod axially slidably mounted on said device and having a head at one end engaging said rotor to lock the same in said first position, the other end of said rod being in the path of movement of said bolt; and a bendable stationary member overlying said head to hold the same in said rotor locking position whereby movement of said bolt to said arming position enforces movement of said rod and head out of rotor locking position by bending and deflecting said bendable stationary member.

2. A fuse device as defined in claim 1 wherein said rotor is provided with a peripheral notch into which said head extends when in rotor locking position.

3. A fuse device as defined in claim 2 wherein the outer periphery of said rotor comprises a toothed crown, said peripheral notch being defined by a space between adjacent teeth of said toothed crown.

* * * * *